US005521685A

United States Patent [19]

Barnes et al.

[11] Patent Number: 5,521,685

[45] Date of Patent: May 28, 1996

[54] FOAM ROLLER CLEANING SYSTEM FOR A LIQUID ELECTROPHOTOGRAPHIC PRINTER

[75] Inventors: Kristina J. Barnes; John A. Thompson, both of Boise, Id.

[73] Assignee: Hewlett-Packard Company, Palo Alto, Calif.

[21] Appl. No.: 450,756

[22] Filed: May 25, 1995

[51] Int. Cl.[6] ..... G03G 15/10

[52] U.S. Cl. ..... 355/256; 118/652

[58] Field of Search ..... 355/256, 307; 118/652, 661, 261, 262; 15/256.52; 354/318

[56] References Cited

U.S. PATENT DOCUMENTS

| | | | |
|---|---|---|---|
| 3,654,654 | 4/1972 | Abreu et al. | 355/307 X |
| 4,258,115 | 3/1981 | Magome et al. | 118/652 X |
| 4,372,244 | 2/1983 | Rebel | 118/262 X |

FOREIGN PATENT DOCUMENTS 2-306275 12/1990 Japan .

*Primary Examiner*—Joan H. Pendegrass
*Assistant Examiner*—Sophia S. Chen

[57] ABSTRACT

A foam roller cleaning system for removing excess toner and carrier in an LEP printer includes a foam roller, having a reduced outer foam layer thickness, that is retractably engagable with an adjacent wringer bar for selective yet complete compression of the foam roller. The outer foam layer thickness is reduced to limit the volume of toner that can accumulate in the foam and, consequently, to reduce the build-up of toner solids therein. The complete compression of the outer foam layer by the wringer bar ensures removal of substantially all toner from the foam to prevent toner solids build-up and to improve cleaning of the foam. The retractable engagement of the foam roller with the wringer bar prevents compression set in the foam roller for improved cleaning of the developer and rigidizing/squeegee rollers and improved useful life of the foam roller.

13 Claims, 1 Drawing Sheet

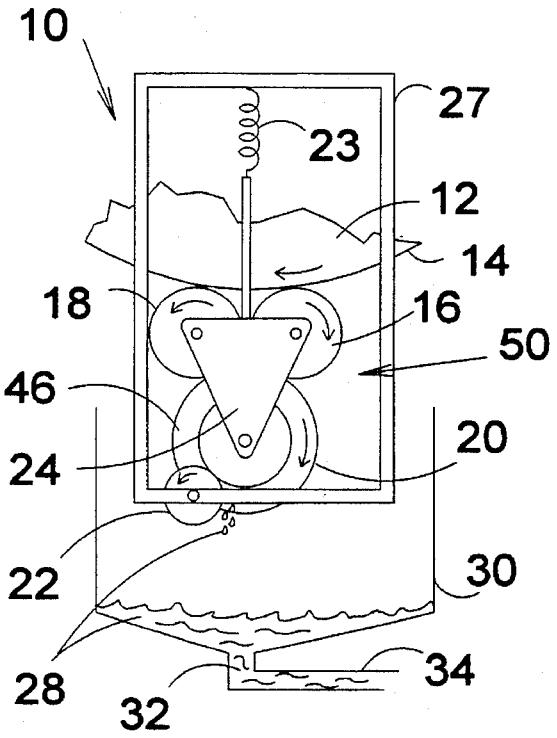
FIG. 1
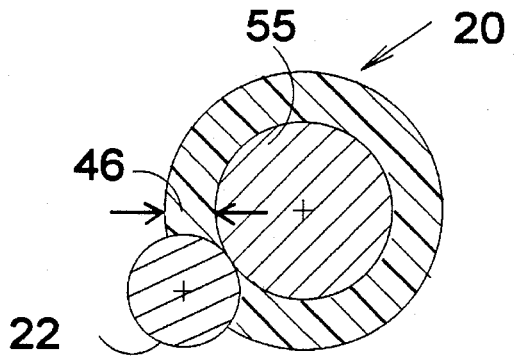
FIG. 4
FIG. 2
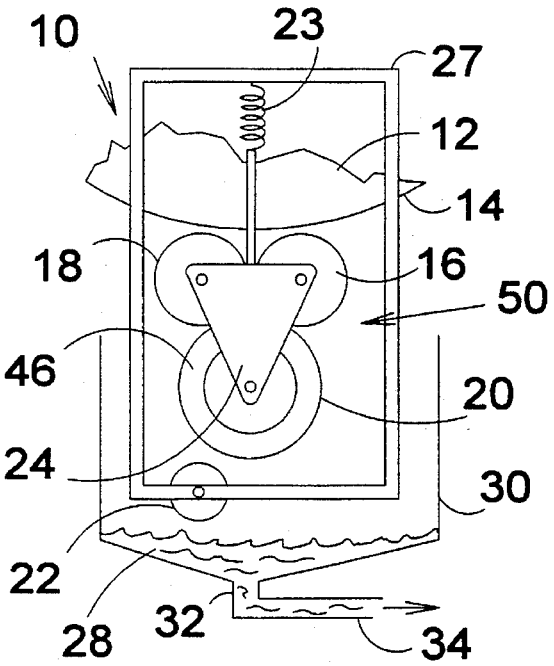
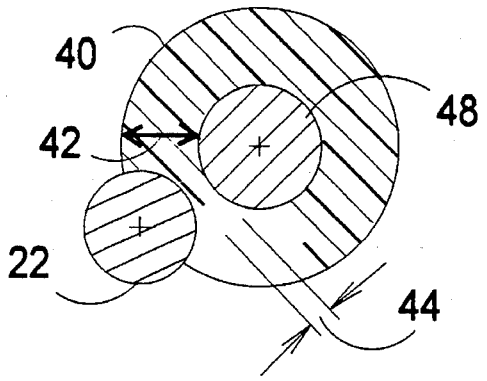
FIG. 3
(PRIOR ART)

FOAM ROLLER CLEANING SYSTEM FOR A LIQUID ELECTROPHOTOGRAPHIC PRINTER

FIELD OF THE INVENTION

This invention relates in general to image transfer technology and, more specifically, to cleaning of liquid electrophotographic printing components.

BACKGROUND OF THE INVENTION

In a liquid electrophotographic (LEP) printer, a latent image is created on the surface of an insulating, photoconducting material by selectively exposing areas of the surface to light. A difference in electrostatic charge density is created between the areas on the surface exposed and unexposed to light. The visible image is developed by electrostatic toners containing pigment dispersed in an insulating carrier liquid. The toners are selectively attracted to the photoconductor surface either exposed or unexposed to light, depending on the relative electrostatic charges of the photoconductor surface, development electrode, and the toner. The photoconductor may be either positively or negatively charged, and the toner system similarly may contain negatively or positively charged particles. For LEP laser printers, the preferred embodiment is that the photoconductor and toner have the same polarity.

A sheet of paper is given an electrostatic charge opposite that of the toner and passed close to the photoconductor surface, which may be in the form of a continuous belt or a rotating drum, pulling the toner from the photoconductor surface onto the paper still in the pattern of the image developed from the photoconductor surface.

A recent demand for color laser printers has prompted designers to use liquid toners with pigment components dispersed in a liquid carrier medium. With liquid toners, however, there is a need to remove the liquid carrier medium from the photoconductor surface after the toner has been applied to it. The photoconductor surface requires carrier and excess toner removal so that it will not transfer the liquid carrier to the paper (or other intermediate transfer medium) in the image transfer step. Also, in this way the liquid carrier may be recovered for recycle and reuse in the developer system, providing economy in terms of printing supplies, and eliminating environmental and health concerns from disposal of excess liquid carrier medium.

LEP printer technology also requires that back-plated and film-formed toner be cleaned from various components in the machine, specifically the developer roller and an image compacting (rigidizing) squeegee roller or metering roller. Back-plated toner is that toner repelled to the developer roller from the photoconductor in the negative of the image that is to be developed on the photoconductor. Film-formed toner is the toner that has begun to dry and, consequently, formed a film.

It has been suggested that cleaning of LEP components be accomplished through the use of a foam roller in U.S. Pat. No. 5,300,990, incorporated in full herein by reference. In this configuration, a foam roller 16 is counter-rotated against the developer roller 14 to clean off the back-plated toner. The foam roller is then wrung out by a wringer bar roller 22 (not shown) located near the bottom of the foam roller and in constant contact with the foam roller.

Several problems result from this configuration. First, the foam roller tends to retain toner solids. This takes the toner out of the printing cycle and reduces the life of a toner cartridge. Second, if the roller is left idle long enough, the solids form a film (film-form) and dry out and the roller adheres to any other adjacent, contacting rollers. Third, when the developer is not rotating (not printing) for a long period of time, the wringer bar creates a large compression set in the foam roller, rendering it useless for cleaning in that area until it has rotated a sufficient number of times to relax the compression set. Depending on the print process, this may or may not occur within one print cycle.

Generally, the problem of toner solids build-up in the foam roller has only been corrected by foam roller replacement when the build-up is too great. However, changing foam rollers is often tedious and expensive.

A prior solution to the problem of compression set has been to let the developer rotate at all times or rotate occasionally to reduce the chance of compression set. Rotation could also conceivably be done during every start-up cycle. However, any system which requires the developer to be rotated during idle periods or upon start-up will be more costly and complex.

There is, therefore, a need for a means of reducing or eliminating foam roller compression set and also a need for a foam roller configuration that permits maximum removal of liquid toner. Accordingly, objects of the present invention are to correct these problems with an efficient yet inexpensive foam roller cleaning system.

SUMMARY OF THE INVENTION

According to principles of the present invention in a preferred embodiment, a foam roller cleaning system in an LEP printer includes a foam roller, having a reduced outer foam layer thickness, that is retractably engagable with an adjacent wringer bar for selective yet complete compression of the foam roller.

Advantageously, the outer foam layer thickness is reduced to limit the volume of toner that can accumulate in the foam and, consequently, to reduce the build-up of toner solids therein. The complete compression of the outer foam layer by the wringer bar ensures removal of substantially all toner from the foam to prevent toner solids build-up and to improve cleaning of the foam. The retractable engagement of the foam roller with the wringer bar prevents compression set in the foam roller for improved cleaning of the developer and rigidizing/squeegee rollers and improved useful life of the foam roller.

The foam roller is connected by a support member to the developer roller and squeegee roller. This connected, roller assembly is vertically spring loaded as part of a developer unit for retractably engaging with a photoconductor and the wringer bar. The wringer bar is also part of the developer unit, although it is rigidly fixed in the developer unit relative to the spring loaded roller assembly. Consequently, as the developer unit is moved upward into a print position, the squeegee roller contacts the photoconductor causing the roller assembly to be pressed (sprung) downward and the foam roller to be pushed into contact with the fixed wringer bar. This contact provides a complete compression of the outer foam layer for improved wringing purposes. As the developer unit moves down and away from the photoconductor for non printing purposes, the roller assembly returns to its original unsprung position so that the foam roller is no longer in contact with the wringer bar, wringing stops, and no compression set of the foam roller results.

Other objects, advantages, and capabilities of the present invention will become more apparent as the description proceeds.

DESCRIPTION OF THE DRAWINGS

FIG. 1 is an elevation view of the present invention foam roller cleaning system in an engaged and printing position in an LEP printer.

FIG. 2 is an elevation view in a retracted and non-printing position.

FIG. 3 is a cross-section of a prior art foam roller and wringer bar.

FIG. 4 is a cross-section of a foam roller engaging a wringer bar according to principles of the present invention.

DETAILED DESCRIPTION OF THE INVENTION

FIG. 1 is an elevation view of the present invention foam roller cleaning system 10 in an engaged and printing position in an LEP printer. Although the present invention is described as being specifically applicable to LEP printers, it is obvious to one of ordinary skill in the art that it is equally applicable to other means employing LEP image transfer technology.

Photoconductor 12 is a movable roller (or loop-type flat belt) used to transfer an image from photoconductive surface 14 to a sheet of paper or other intermediate transfer surface (not shown). Developer roller 16, rigidizing/squeegee roller 18, and foam roller 20 are disposed adjacent each other, are connected to roller support member 24, and together will be referred to herein as roller assembly 50. In the roller assembly, foam roller 20 is in constant contact with developer 16 and squeegee 18 for cleaning of excess toner and liquid carrier therefrom. Although foam roller 20 is not electrically charged in the preferred embodiment, it is understood that it could be charged to improve toner attraction for enhanced cleaning purposes. Wringer bar roller 22 rotatably wrings foam roller 20 of its excess toner and liquid carrier.

Roller assembly 50 is part of developer unit 27 and is spring loaded to it by spring 23 for retractably engaging with photoconductor 12 and wringer bar roller 22. Wringer bar 22 is also part of developer unit 27, although it is rigidly (but rotatably) fixed in the developer unit relative to spring loaded roller assembly 50. Developer unit 27 is shown in a simple frame configuration. However, it is obvious and understood that numerous variations in form will equally satisfy the purposes of retractably engaging roller assembly 50 with photoconductor 12 and wringer bar 22.

In a preferred embodiment, outer foam layer 46 of foam roller 20 removes the excess toner and liquid carrier from developer and squeegee rollers 16 and 18. In turn, outer foam layer 46 is fully compressed by wringer bar roller 22 for removal of the excess toner and liquid carrier from the outer foam layer. Outer foam layer 46 is of a reduced thickness to limit the volume of toner that can accumulate in the foam and, consequently, to reduce the build-up of toner solids therein. The complete compression of outer foam layer 46 by wringer bar 22 ensures removal of substantially all toner liquid 28 from the foam to prevent toner solids build-up and to improve cleaning of the foam. Liquid 28 can then be caught in reservoir 30 and recycled through drain 32 to a pump in line 34 and back to the originating toner bath supply (not shown).

Although rotational directions of the rollers are not absolute, the directions shown represent a preferred embodiment. Namely, photoconductor 12 is shown as being driven in a clockwise direction, and squeegee roller 18 is frictionally driven (by photoconductor 12) in a counterclockwise direction. Developer roller 16 is mechanically driven in either direction since it has a clearance of about 50 μm from photoconductor 12. However, a preferred developer rotation would be clockwise at about three times the surface speed of photoconductor 12.

Foam roller 20 is also mechanically driven in either direction, but a preferred rotation is clockwise and, therefore, in surface motion opposition to developer roller 16. Wringer bar 22 is frictionally driven by foam roller 20. A preferred surface speed of foam roller 20 is about three to four times the directionally opposing surface speed of developer roller 16. Although the speed of foam roller 20 may vary from that preferred here, it is recognized that the faster foam roller 20 rotates relative to developer roller 16, the more unnecessary wear will occur to the foam roller. On the other hand, if foam roller 20 is rotated too slowly, cleaning of developer roller 16 and squeegee roller 18 is diminished.

In the preferred embodiment, the engaged and printing position shown in FIG. 1 is achieved by an actuation movement of developer unit 27 upward toward photoconductor 12. Movement of developer unit 27 is accomplished by any conventional, mechanical, actuating means in the art. The specific type of actuating means is not pertinent to the present invention other than it must provide accurate and sufficient movement control for retractably engaging squeegee 18 with photoconductor 12, and foam roller 20 with wringer bar 22. Namely, as developer unit 27 is moved upward into a print position, squeegee roller 18 contacts photoconductor 12 causing roller assembly 50 to be pressed (sprung) downward against spring tension 23 and foam roller 20 to be pushed into contact with fixed wringer bar 22. This contact provides a full and complete compression of outer foam layer 46 against wringer bar 22 for improved wringing purposes.

Referring now to FIG. 2, an elevation view shows foam roller cleaning system 10 in a retracted and non-printing position. In this state, developer roller 16 and squeegee roller 18 are retracted away from photoconductor surface 14, and foam roller 20 is retracted away from wringer bar 22. This is accomplished by a downward actuation movement of developer unit 27. As developer unit 27 moves down and away from photoconductor 12 for non printing purposes, roller assembly 50 returns to its original unsprung position so that developer roller 16 and squeegee roller 18 are no longer in contact with photoconductor 12, foam roller 20 is disengaged from wringer bar 22, and wringing stops. The retraction of foam roller 20 from wringer bar 22 (or equally said, the retraction of wringer bar 22 from foam roller 20) prevents compression set in the foam roller which would be caused by wringer bar 22 after prolonged compression against foam roller 20 if the rollers were not retracted. Avoiding compression, as such, provides improved cleaning potential by foam roller 20 of the developer and squeegee rollers, and an improved useful life of the foam roller itself.

Although FIGS. 1 and 2 depict the preferred embodiment for retractably engaging foam roller 20 with wringer bar roller 22, it is obvious that with minor modifications the rollers can be retractably engaged by other similar means and methods. For example, roller assembly 50 could remain stationary, whereby photoconductor 12 and wringer bar 22 would each be moved into contact with roller assembly 50 for printing/cleaning purposes. Similarly, photoconductor 12 could be moved down against roller assembly 50 causing foam roller 20 to engage with wringer bar 22. Or, wringer bar 22 could be moved upward against foam roller 22 for an engaged, printing position. However, regardless of the exact actuation means for engaging the rollers, the important aspect is that the rollers be retractably engaged to avoid compression set of foam roller 20.

It should also be noted here that spring 23 is merely representative of the variations that could be employed for supplying the retractable movement of roller assembly 50 relative to photoconductor 12 and wringer bar 22. For example, other forms of spring-like means could be used to support roller assembly 50, or the springs could just as equally be located differently, such as relative to the floor of the system rather than the ceiling of the system.

Similarly, it is noted that the total vertical movement of roller assembly 50 must be greater than outer foam layer thickness 46 in order to totally disengage foam roller 20 from wringer bar roller 22. Furthermore, the total vertical movement is a function of the angle between the vertical and a line connecting the centers of foam roller 20 and wringer roller 22.

Referring now to FIG. 3, a typical prior art foam roller 40 is shown over a center substrate rod 48 and engaging an adjacent wringer bar roller 22. Conventionally, a thickness of the outer foam layer may be about 10 mm, as shown at dimension 42. Furthermore, wringer bar 22 is formed and placed such that not all of the foam of the foam roller is compressed. As such, interior foam section 44 (about 5 mm thick) is not fully compressed and, consequently, retains a significant volume of toner and carrier liquid 28 which has been absorbed and wiped from squeegee 18 and developer 16. The retention of toner and carrier liquid within foam roller 40 causes an unwanted build up of the same which prevents proper functioning of foam roller 40 and, ultimately, the entire LEP system.

FIG. 4 shows how the uncompressed foam section 44 (of FIG. 3) is eliminated according to principles of the present invention by using a foam roller 20 having a significantly reduced outer foam layer thickness 46 over a center substrate rod 55. By using the reduced thickness 46, wringer bar 22 is able to totally compress the foam to remove the majority of absorbed fluid, thereby minimizing retention of toner and subsequent sticking to the other rollers 16 and 18. A preferred outer foam layer thickness 46 is between 3 mm and 6 mm for a 25 mm to 30 mm total diameter foam roller (including center rod 55 and outer foam layer 46). A preferred material for outer layer 46 is an open cell polyurethane having about 4 pores/mm (100/inch) and a density of about 0.032 g/cm$^3$ (2 lbs/ft$^3$) for absorbing the toner liquid and for subsequently being wrung out by wringer bar 22. However, under principles of the present invention, other similar, pliable, absorptive materials may likewise be used. Squeegee roller 18 would typically consist of an elastomer material layer on a center shaft. Wringer bar 22 is, typically, a stainless steel shaft. These noted dimensions are sized for a developer roller of about 20 mm diameter, a squeegee roller of about 15 mm diameter, and a wringer bar roller of about 6 mm in diameter. Obviously, dimensions of the foam roller center rod, outer foam layer, and wringer bar could vary respectively with the developer and squeegee rollers.

What has been described above are the preferred embodiments for a foam roller cleaning system in an LEP printer including a foam roller, having a reduced outer foam layer thickness, that is retractably engagable with an adjacent wringer bar for selective yet complete compression of the foam roller. It will be obvious that the present invention is easily implemented utilizing any of a variety of conventional or slightly modified hardware components existing in the art. Accordingly, while the present invention has been described by reference to specific embodiments, it will be obvious that other alternative embodiments and methods of implementation or modification may be employed without departing from the true spirit and scope of the invention.

What is claimed is:

1. A liquid electrophotographic (LEP) roller cleaning system, comprising:

(a) a first roller for cleaning a second adjacent roller, the first roller rotatably affixed to a first support means;

(b) a wringer bar roller adjacent the first roller; and, (c) actuating means for retractably engaging the first roller and the wringer bar roller with each other, whereby the wringer bar roller wrings the first roller in an engaged position, and the wringer bar roller does not contact the first roller in a retracted position thereby avoiding compression set of the first roller, the actuating means including a spring means connected to the first support means, and wherein the wringer bar roller is rotatably affixed to the actuating means, whereby the first roller and wringer bar are moved from the retracted position to the engaged position in response to a force applied to the actuating means, and whereby upon release of the force, the first roller and wringer bar return to the retracted position.

2. The roller cleaning system of claim 1 wherein the first roller includes at least an outer layer of pliable, absorptive material for absorbing toner and toner carrier fluid from the second adjacent roller.

3. The roller cleaning system of claim 2 wherein the outer layer of material comprises an open cell polyurethane material.

4. The roller cleaning system of claim 2 wherein the outer layer of material has a thickness of about 2 mm–8 mm.

5. The roller cleaning system of claim 2 wherein the outer layer of material is completely compressed by the wringer bar in the engaged position.

6. The roller cleaning system of claim 1 further including a photoconductor, and wherein the engaged position is a result of the force upon the actuating means being in a direction toward the photoconductor.

7. A liquid electrophotographic (LEP) printer roller cleaning system, comprising:

(a) a foam roller for cleaning an adjacent developer roller and rigidizing/squeegee roller, the foam roller having at least an outer layer of pliable, absorptive material for absorbing toner and toner carrier fluid from the developer and rigidizing/squeegee rollers, and wherein the foam roller, developer roller, and rigidizing/squeegee roller are each rotatably affixed to a first support member thereby forming a roller assembly;

(b) a wringer bar roller adjacent the foam roller, the wringer bar roller rotatably affixed to a second support member; and, (c) a spring means attached between the first support member and the second support member, whereby upon a force being applied to the second support member, the foam roller and wringer bar roller are placed into an engaged position from a retracted position such that a thickness of the outer layer of the foam roller is fully compressed by the wringer bar roller, and whereby upon the force being released, the roller assembly returns to the retracted position such that the wringer bar roller does not contact the foam roller, thereby avoiding compression set of the foam roller.

8. The roller cleaning system of claim 7 wherein the outer layer of material comprises an open cell polyurethane material.

9. The roller cleaning system of claim 8 wherein the outer layer of material has a thickness of about 2 mm–8 mm.

10. The roller cleaning system of claim 7 further including a photoconductor, and wherein the force applied to the second support member is in a direction toward the photoconductor for engaging the foam roller and wringer bar roller.

11. A method of cleaning a cleaning roller in a liquid electrophotographic (LEP) image transfer device, the cleaning roller having at least an outer layer of pliable, absorptive material for cleaning adjacent rollers, and the LEP device having a wringer bar roller for wringing the cleaning roller, the method comprising:

(a) placing the cleaning roller and the wringer bar roller in contact with each other in an engaged position during a print cycle of the LEP device such that a thickness of the outer layer of the cleaning roller is fully compressed by the wringer bar roller in the engaged position, and whereby the wringer bar roller wrings the outer layer of the cleaning roller; and, (b) retracting one of the cleaning roller and wringer bar roller from the other during a non print cycle of the LEP device to a non contacting, retracted position such that compression set of the cleaning roller is avoided in the retracted position.

12. The method of claim 11 wherein the outer layer of material comprises an open cell polyurethane material.

13. The method of claim 11 wherein the outer layer of material has a thickness of about 2 mm–8 mm.

* * * * *